US006694884B2

(12) United States Patent
Klinefelter et al.

(10) Patent No.: US 6,694,884 B2
(45) Date of Patent: Feb. 24, 2004

(54) METHOD AND APPARATUS FOR COMMUNICATING BETWEEN PRINTER AND CARD SUPPLY

(75) Inventors: Gary M. Klinefelter, Eden Prairie, MN (US); Jeffrey D. Upin, Edina, MN (US); Gary A. Lenz, Eden Prairie, MN (US); Martin A. Pribula, Eden Prairie, MN (US); James R. Meier, St. Paul, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 10/071,554

(22) Filed: Feb. 8, 2002

(65) Prior Publication Data

US 2002/0059880 A1 May 23, 2002

Related U.S. Application Data

(63) Continuation-in-part of application No. 09/489,591, filed on Jan. 21, 2000, now Pat. No. 6,386,772, which is a continuation-in-part of application No. 09/967,501, filed on Sep. 28, 2001, now Pat. No. 6,536,758.

(60) Provisional application No. 60/117,123, filed on Jan. 25, 1999.

(51) Int. Cl.[7] ..... B41J 11/58

(52) U.S. Cl. ..... 101/484; 400/624; 271/104; 358/1.14; 235/380

(58) Field of Search ..... 101/484; 271/104; 400/208, 624, 625; 235/380; 358/1.18, 1.14

(56) References Cited

U.S. PATENT DOCUMENTS

| | | | | |
|---|---|---|---|---|
| 3,598,396 | A | 8/1971 | Andrews et al. | 271/9 |
| 3,755,653 | A | 8/1973 | Venker | 235/61.11 |
| 3,889,472 | A | 6/1975 | Guillaud | 60/698 |
| 3,960,072 | A | 6/1976 | Ahlgren et al. | 101/35 |
| 4,015,839 | A | 4/1977 | McKee | 271/37 |
| 4,017,068 | A | 4/1977 | McKee | 271/275 |
| 4,031,518 | A | 6/1977 | Holloran et al. | 340/172.5 |
| 4,068,028 | A | 1/1978 | Samonides | 428/40 |
| 4,102,267 | A | 7/1978 | Ritzerfeld | 101/132.5 |
| 4,146,900 | A | 3/1979 | Arnold | 346/75 |

(List continued on next page.)

FOREIGN PATENT DOCUMENTS

| | | |
|---|---|---|
| DE | 25 35 699 A1 | 3/1977 |
| EP | 0 562 979 | 9/1993 |
| EP | 0 887 197 | 12/1998 |
| EP | 0 979 736 | 2/2000 |
| GB | 2 120 821 A | 12/1983 |
| JP | 411105359 A | 4/1999 |
| JP | 11 265463 | 9/1999 |
| WO | WO 95/09084 | 4/1995 |
| WO | WO 99/04368 | 1/1999 |
| WO | WO 99/21713 | 5/1999 |
| WO | 99/49379 | 9/1999 |
| WO | WO 00/43932 | 7/2000 |

OTHER PUBLICATIONS

09/189959 Filed Nov. 10, 1998 Holic now Abandoned.*

International Search Report from International Application No. PCT/US 03/06187, filed Feb. 28, 2003. Search report dated Jul. 18, 2003.

(List continued on next page.)

*Primary Examiner*—Eugene H. Eickholt

(74) *Attorney, Agent, or Firm*—Westman, Champlin & Kelly

(57) ABSTRACT

A card supply for use with an identification card printing system includes a card hopper and a supply circuit. The card hopper contains a stack of cards. The supply circuit is mounted to the card hopper that includes a memory containing supply information relating to parameters of the card supply.

47 Claims, 9 Drawing Sheets

U.S. PATENT DOCUMENTS

| | | | | | |
|---|---|---|---|---|---|
| 4,161,312 | A | | 7/1979 | Eckhardt et al. | 271/3 |
| 4,393,386 | A | | 7/1983 | Di Giulio | 346/75 |
| 4,534,313 | A | | 8/1985 | Louvel | 118/696 |
| 4,604,631 | A | | 8/1986 | Jinnai et al. | 346/1.1 |
| 4,680,596 | A | | 7/1987 | Logan | 346/140 |
| 4,685,702 | A | | 8/1987 | Kazuharu | 283/81 |
| 4,686,540 | A | | 8/1987 | Leslie et al. | 346/33 |
| 4,716,346 | A | | 12/1987 | Matsuo | 318/38 |
| 4,734,868 | A | | 3/1988 | DeLacy | 364/519 |
| 4,781,985 | A | | 11/1988 | Desjarlais | 428/421 |
| 4,782,363 | A | | 11/1988 | Britt et al. | 355/14 |
| 4,797,018 | A | | 1/1989 | Hofmann et al. | 400/208 |
| 4,845,490 | A | | 7/1989 | Ward et al. | 340/825.31 |
| 4,961,088 | A | | 10/1990 | Gilliland et al. | 355/206 |
| 4,970,544 | A | * | 11/1990 | Furusawa et al. | 355/24 |
| 5,019,839 | A | | 5/1991 | Watanabe et al. | 346/134 |
| 5,027,288 | A | * | 6/1991 | Suzuki et al. | 358/1.18 |
| 5,077,467 | A | | 12/1991 | Barron, Jr. et al. | 250/221 |
| 5,111,239 | A | | 5/1992 | Kamimura et al. | 355/45 |
| 5,138,344 | A | | 8/1992 | Ujita | 400/175 |
| 5,149,211 | A | | 9/1992 | Pettigrew | 400/88 |
| 5,184,181 | A | | 2/1993 | Kurando et al. | 355/260 |
| 5,239,926 | A | | 8/1993 | Nubson et al. | 101/487 |
| 5,266,781 | A | * | 11/1993 | Warwick et al. | 235/380 |
| 5,266,968 | A | | 11/1993 | Stephenson | 400/208 |
| 5,267,800 | A | | 12/1993 | Petterutl et al. | 400/88 |
| 5,277,501 | A | | 1/1994 | Tanaka et al. | 400/120 |
| 5,318,370 | A | | 6/1994 | Nehowig | 400/207 |
| 5,327,201 | A | | 7/1994 | Coleman et al. | 355/278 |
| 5,368,677 | A | | 11/1994 | Ueda et al. | 156/362 |
| 5,455,617 | A | | 10/1995 | Stephenson et al. | 400/207 |
| 5,466,319 | A | | 11/1995 | Zager et al. | 156/220 |
| 5,502,464 | A | | 3/1996 | Takahashi et al. | 346/25 |
| 5,516,218 | A | | 5/1996 | Amano et al. | 400/535 |
| 5,530,468 | A | | 6/1996 | Yoshimi et al. | 347/262 |
| 5,642,877 | A | | 7/1997 | Green | 271/35 |
| 5,646,388 | A | | 7/1997 | D'Entremont et al. | 235/380 |
| 5,695,589 | A | | 12/1997 | German et al. | 156/250 |
| 5,703,347 | A | | 12/1997 | Reddersen et al. | 235/472 |
| 5,707,162 | A | | 1/1998 | Kasal et al. | 400/692 |
| 5,709,484 | A | | 1/1998 | Dorner | 400/188 |
| 5,755,519 | A | | 5/1998 | Klinefelter | 400/249 |
| 5,772,199 | A | | 6/1998 | Green | 271/10.06 |
| 5,814,796 | A | * | 9/1998 | Benson et al. | 235/380 |
| 5,820,281 | A | | 10/1998 | Hill et al. | 400/621 |
| 5,837,991 | A | | 11/1998 | LaManna et al. | 235/475 |
| 5,882,127 | A | | 3/1999 | Amano | 400/521 |
| 5,889,866 | A | * | 3/1999 | Cyras et al. | 380/49 |
| 5,936,008 | A | | 8/1999 | Jones et al. | 523/161 |
| 5,974,085 | A | * | 10/1999 | Smith | 375/220 |
| 5,978,621 | A | | 11/1999 | Glemser et al. | 399/90 |
| 5,980,011 | A | | 11/1999 | Cummins et al. | 347/4 |
| 5,995,774 | A | | 11/1999 | Applegate et al. | 399/27 |
| 6,011,741 | A | | 1/2000 | Wallace et al. | 365/221 |
| 6,037,879 | A | | 3/2000 | Tuttle | 340/825.54 |
| 6,039,430 | A | | 3/2000 | Helterline et al. | 347/19 |
| 6,071,024 | A | | 6/2000 | Chi-Ming et al. | 347/177 |
| 6,072,402 | A | | 6/2000 | Kniffin et al. | 340/825 |
| 6,076,913 | A | | 6/2000 | Garcia et al. | 347/19 |
| 6,099,101 | A | | 8/2000 | Maurelli et al. | 347/7 |
| 6,099,178 | A | | 8/2000 | Spurr et al. | 400/207 |
| 6,113,208 | A | | 9/2000 | Benjamin et al. | 347/7 |
| 6,163,658 | A | | 12/2000 | Suzuki | 399/12 |
| 6,179,401 | B1 | | 1/2001 | Stephens, Jr. et al. | 347/19 |
| 6,213,392 | B1 | | 4/2001 | Zuppicich | 235/380 |
| 6,220,511 | B1 | * | 4/2001 | Holec et al. | 235/380 |
| 6,252,791 | B1 | | 6/2001 | Wallace et al. | 365/221 |
| 6,253,329 | B1 | | 6/2001 | Kang | 713/300 |
| 6,263,170 | B1 | | 7/2001 | Bortnem | 399/13 |
| 6,264,296 | B1 | | 7/2001 | Klinefelter et al. | 347/4 |
| 6,264,301 | B1 | | 7/2001 | Helterline et al. | 347/19 |
| 6,267,463 | B1 | | 7/2001 | Paulsen | 347/19 |
| 6,271,928 | B1 | | 8/2001 | Bullock et al. | 358/1.16 |
| 6,298,336 | B1 | * | 10/2001 | Davis et al. | 705/41 |
| 6,302,527 | B1 | | 10/2001 | Walker | 347/50 |
| 6,305,795 | B2 | | 10/2001 | Childers et al. | 347/86 |
| 6,312,083 | B1 | | 11/2001 | Moore | 347/19 |
| 6,312,106 | B1 | | 11/2001 | Walker | 347/50 |
| 6,325,495 | B1 | | 12/2001 | Foth | 347/84 |
| 6,341,839 | B1 | | 1/2002 | Burikov et al. | 347/37 |
| 6,371,586 | B1 | | 4/2002 | Saruta | 347/7 |
| 6,386,772 | B1 | * | 5/2002 | Klinefelter et al. | 400/208 |
| 6,405,055 | B1 | | 6/2002 | Silverbrook et al. | 455/556 |
| 6,464,317 | B2 | | 10/2002 | Miyazawa | 347/14 |
| 2002/0051167 | A1 | * | 5/2002 | Francis et al. | 358/1.14 |

OTHER PUBLICATIONS

Streamfeeder—ST 1250 Universal Friction Feeder; last modified Feb. 27, 2000; 1 page with heading of "Streamfeeder—Product Index"; and 3 pages with heading of "Streamfeeder—ST 1250 Universal Friction Feeder".

"Standard Read/Write Identification IC", by TEMIC Semiconductor GmbH, Heilbronn, Germany, (Apr. 1999).

"Introducing the New SmartGuard™ and SmartShield™ Advanced Security Options", pamphlet by Fargo Electronics, Inc., Eden Prairie, Minnesota (1998).

"RFID Tagging IC is First to Accept Input from Sensors", by Microchip Technology Inc., (undated).

Two page web site advertisement from SEIKO Precision, entitled "The lastest design for your CD–R", re: CD Printer 2000.

Two page web site advertisement from SEIKO Precision, entitled "CD Printer 2000".

Two page web site advertisement from SEIKO Precision, entitled "CD Printer 4000".

Partial International Search for International Application No. PCT/US 01/17146, filed May 25, 2001 (with Invitation to Pay Fees).

International Search Report for International Application No. PCT/US 00/01697, filing date Jan. 21, 2000, dated Oct. 18, 2000.

* cited by examiner

| BIT | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|---|---|---|---|---|---|---|---|---|---|---|---|---|---|---|---|
| BLOCK 0 | MODE DATA (NOT NORMALLY TRANSMITTED) | | | | | | | | | | | | | | | | | | | | | | | | | | | | | | | |
| BLOCK 1 | SUPPLY IDENTIFIER | | | | | | | | | | | | CARD COUNT | | | | | | | | REMAINING COUNT | | | | | | | | DEALER INFO | | | |
| BLOCK 2 | CARD FEATURES | | | | | | | | | | | | EXPIRATION DATE | | | | | | | | | | | | CARD IDENTIFIER | | | | | | | |
| BLOCK 3 | SECURITY CODES | | | | | | | CARD TYPE | | | | | CARD DIMENSIONS | | | | | | | | SUPPLIER INFO | | | | | | | | ORIENTATION | | | |
| BLOCK 4 | INTERLOCK | | | | | | | | | | | | | | | | | | | | | | | | | | | | | | | |
| BLOCK 5 | CUSTOMIZABLE LOCKING FEATURE | | | | | | | | | | | | | | | | | | | | | | | | | | | | | | | |
| BLOCK 6 | PRINTER SETTINGS | | | | | | | | | | | | | | | | | | | | | | | | | | | | | | | |
| BLOCK 7 | USER DATA | | | | | | | | | | | | | | | | | | | | | | | | | | | | | | | |

FIG. 6

METHOD AND APPARATUS FOR COMMUNICATING BETWEEN PRINTER AND CARD SUPPLY

This is a Continuation-in-Part of U.S. application Ser. No. 09/489,591, filed Jan. 21, 2000, and entitled "METHOD AND APPARATUS FOR COMMUNICATING BETWEEN PRINTER OR LAMINATOR AND SUPPLIES," now U.S. Pat. No. 6,386,772 which in turn claims priority to U.S. Provisional Application Serial No. 60/117,123, which was filed Jan. 25, 1999; and this application is also a Continuation in Part of U.S. patent application Ser. No. 09/967,501, entitled "CARD HOPPER," filed Sep. 28, 2001 now U.S. Pat. No. 6,536,758. All of the above-identified references are incorporated herein by reference.

FIELD OF THE INVENTION

The present invention relates to identification card printing systems. More particularly, the present invention relates to a card supply for use with an identification card printing system that includes a supply circuit that contains supply information relating to parameters of the card supply.

BACKGROUND OF THE INVENTION

Identification cards are widely used to carry information relating to the card holder, for example. The use of such identification cards is becoming more and more widespread and they are used for many purposes, such as driver's licenses, identification badges, etc. In the past, identification cards have been manufactured using a labor intensive process in which an individual's data was manually stamped or imprinted onto a card. In some cases, an instant photograph was taken of the subject and adhered or laminated to a card. Today, the manufacturer of identification cards has become increasingly automated. An individual's data may be obtained from a computer database and formatted by software running on a computer to generate a print job. The print job can then be provided to an identification card printing system for printing onto a card substrate to form the identification card.

Identification card printing systems generally include a card supply, a printing mechanism, and a transport mechanism for delivering individual cards from the card supply to the print mechanism for printing. The card supply includes a stack of cards stored in a hopper, which can be fed individually to the transport mechanism. The print mechanism can be an ink jet printhead, a thermal printhead, or other suitable type of print mechanism. In operation, individual cards are fed from the card supply and are transported along a print path by the transporter mechanism to the printhead for printing.

Prior art identification card printing systems require an operator to check various supplies of the printer prior to commencing the processing of a print job to ensure that the print job can be completed as desired. For example, it is necessary that the operator check the card supply to ensure that the card type, the orientation of the cards, and the number of cards remaining in the card supply satisfy the needs of the print job. These checks of various card supply information can be time consuming and, if not performed, could lead to spoiled supplies due to improper printer setup resulting in increased operation costs.

SUMMARY OF THE INVENTION

The present invention is directed to a card supply for use within an identification card printing system that provides benefits over the prior art. The card supply includes a card hopper and a supply circuit. The card hopper contains a stack of cards. The supply circuit is mounted to the card hopper and includes a memory containing supply information relating to parameters of the card supply.

Another embodiment of the invention is directed to a method for use with an identification card printing system to manage the above-described card supply. In the method, supply information is retrieved from the memory and used during the processing of cards by the identification card printing system.

BRIEF DESCRIPTION OF THE DRAWINGS

FIG. 6 is a memory map of a memory of a supply circuit in accordance with an embodiment of the invention.

DETAILED DESCRIPTION OF THE PREFERRED EMBODIMENTS

Figure 1:
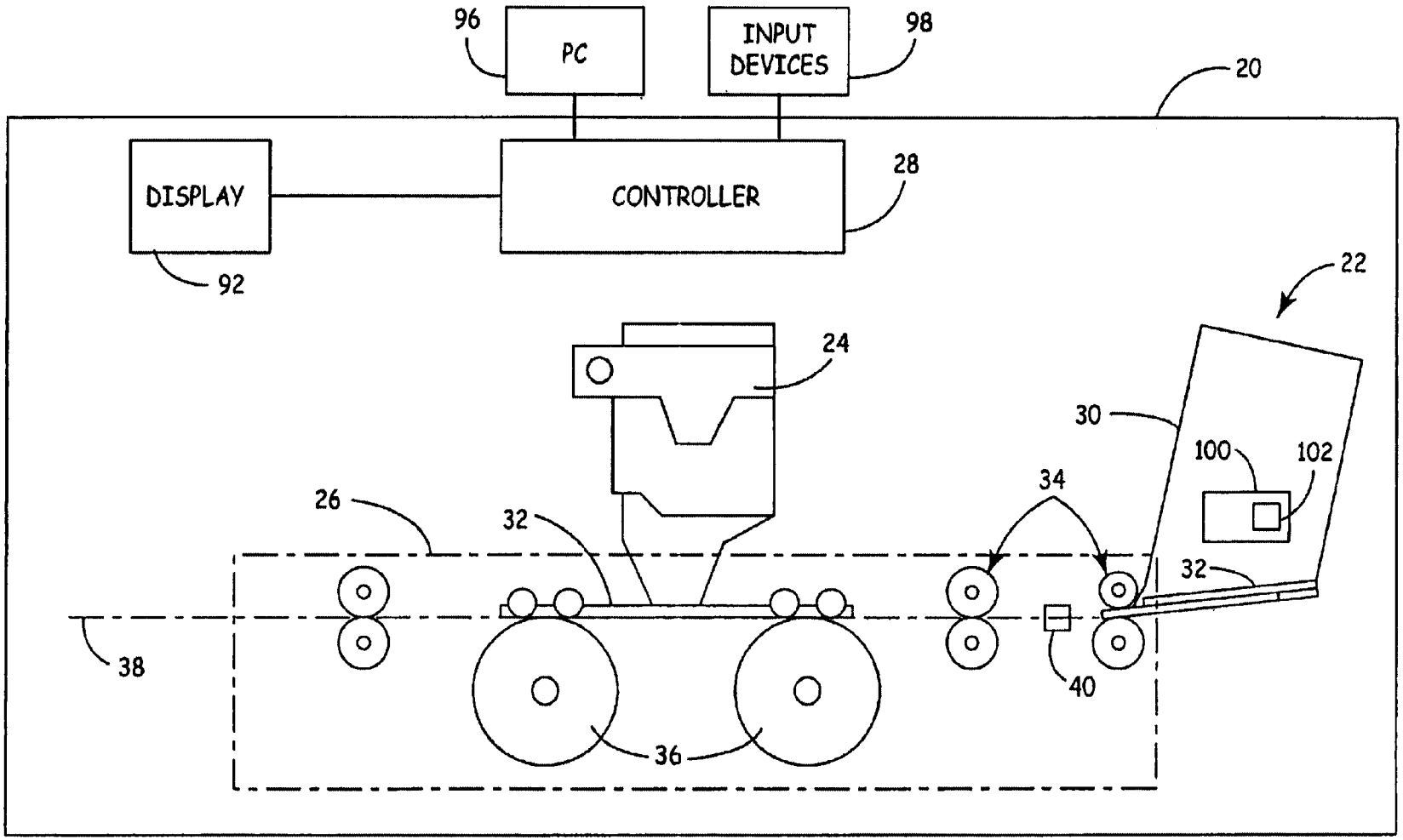
FIG. 1 is a simplified block diagram of an identification card printer in accordance with various embodiments of the invention.

FIG. 1 is a simplified block diagram of an identification card printing system 20, with which embodiments of the present invention may be used. Printing system 20 generally includes a card supply 22, a printhead 24, a transport mechanism 26 and a controller 28. Card supply 22 includes a card hopper 30 containing a stack of cards 32. Transport mechanism 26 generally comprises a plurality of pinch rollers 34 and guide rollers 36 that transport individual cards 32 from card supply 22 along a print path 38 and present the cards 32 to printhead 24 for printing.

Printhead 24 can be any conventional printhead, such as an inkjet printhead (shown) that receives a supply of ink, or a thermal printhead that transfers ink from a thermal print ribbon. An example of an identification card printing system utilizing an inkjet printhead is described in U.S. patent application Ser. No. 09/866,309, entitled "INK JET CARD PRINTER," filed May 25, 2001. An example of an identification card printing system using a thermal printhead is described in U.S. Pat. No. 6,241,332. Both of the above-identified references are incorporated herein by reference.

Printing system 20 can also include a sensor 40 that is adapted to sense cards 32 that are being processed. Sensor 40 is configured to detect a feature of a transported or process card 32 and includes an output signal 42 that provides detected card information to controller 28. The feature on card 32 can be a marking on the card that is detectable by the sensor, such as a hologram, a barcode, a pattern, or a watermark (steganography). Alternatively, sensor 40 can be adapted to detect an event in printing system 20 that otherwise indicates the processing of a card 32.

Figure 2:
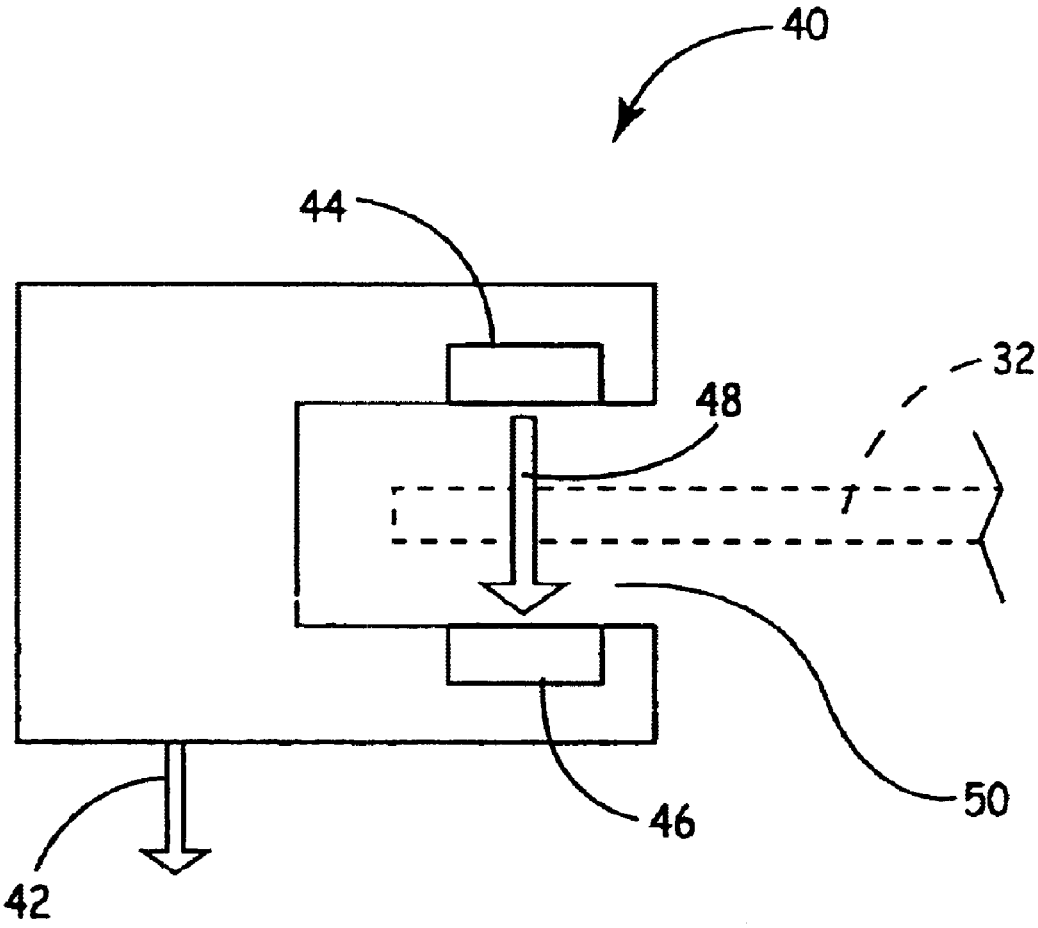
FIG. 2 is a simplified side plan view of a sensor in accordance with an embodiment of the invention.

In accordance with one embodiment of the invention, sensor 40 includes a signal source 44 and a signal receiver 46, as shown in FIG. 2. Signal source 44 produces a signal 48, such as a light signal, that can be received by signal receiver 46. As cards 32 are processed or transported by printing system 20, they pass through a gap 50 between signal source 44 and signal receiver 46. This breaks the signal 48 between source 100 and receiver 102. The breaking of the signal 48 indicates the existence of a card being processed or transported. The output signal 42 can then communicate that information to controller 28.

Figure 3:
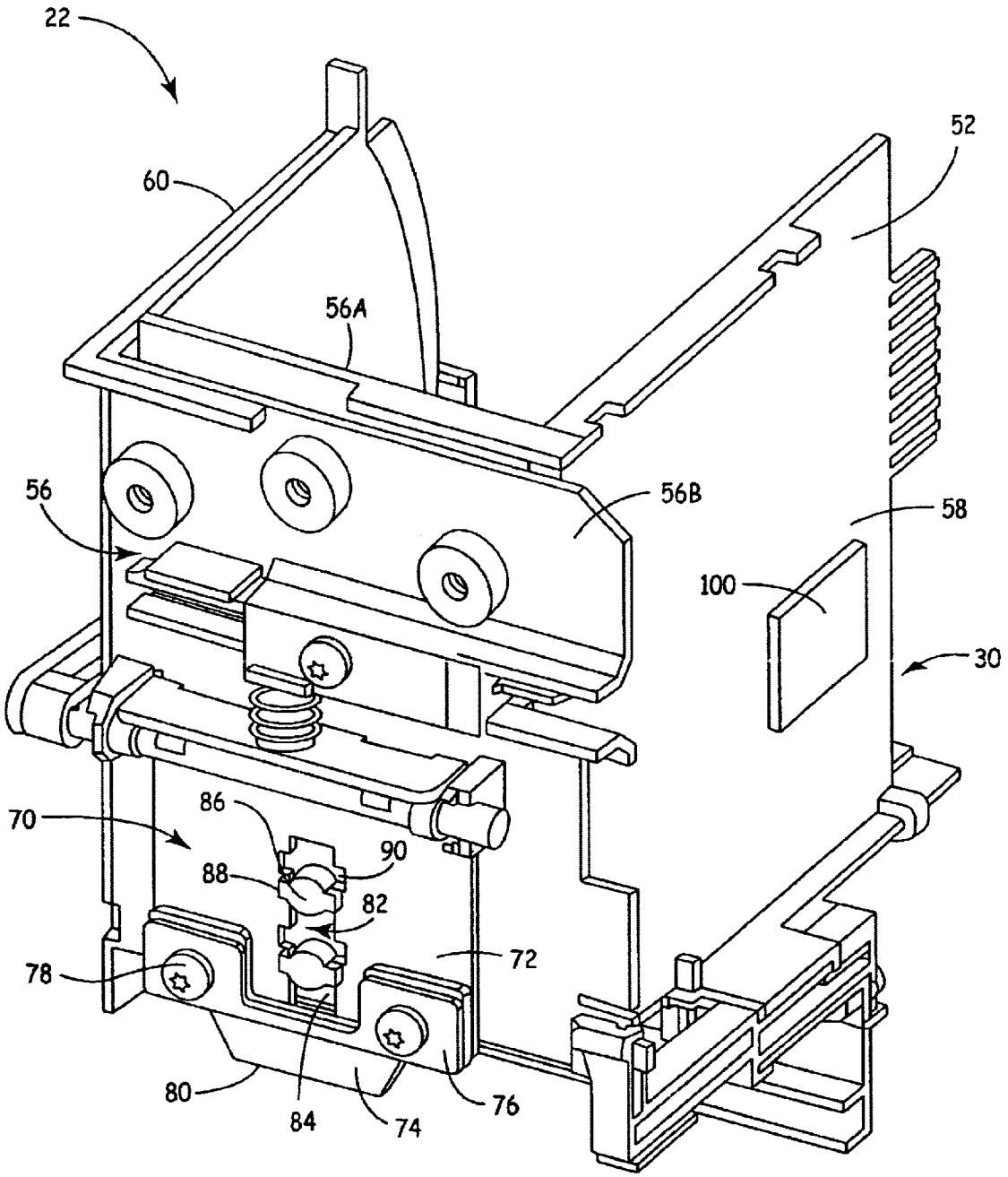
FIG. 3 is a perspective view of a card supply in accordance with an embodiment of the invention.
Figure 4:
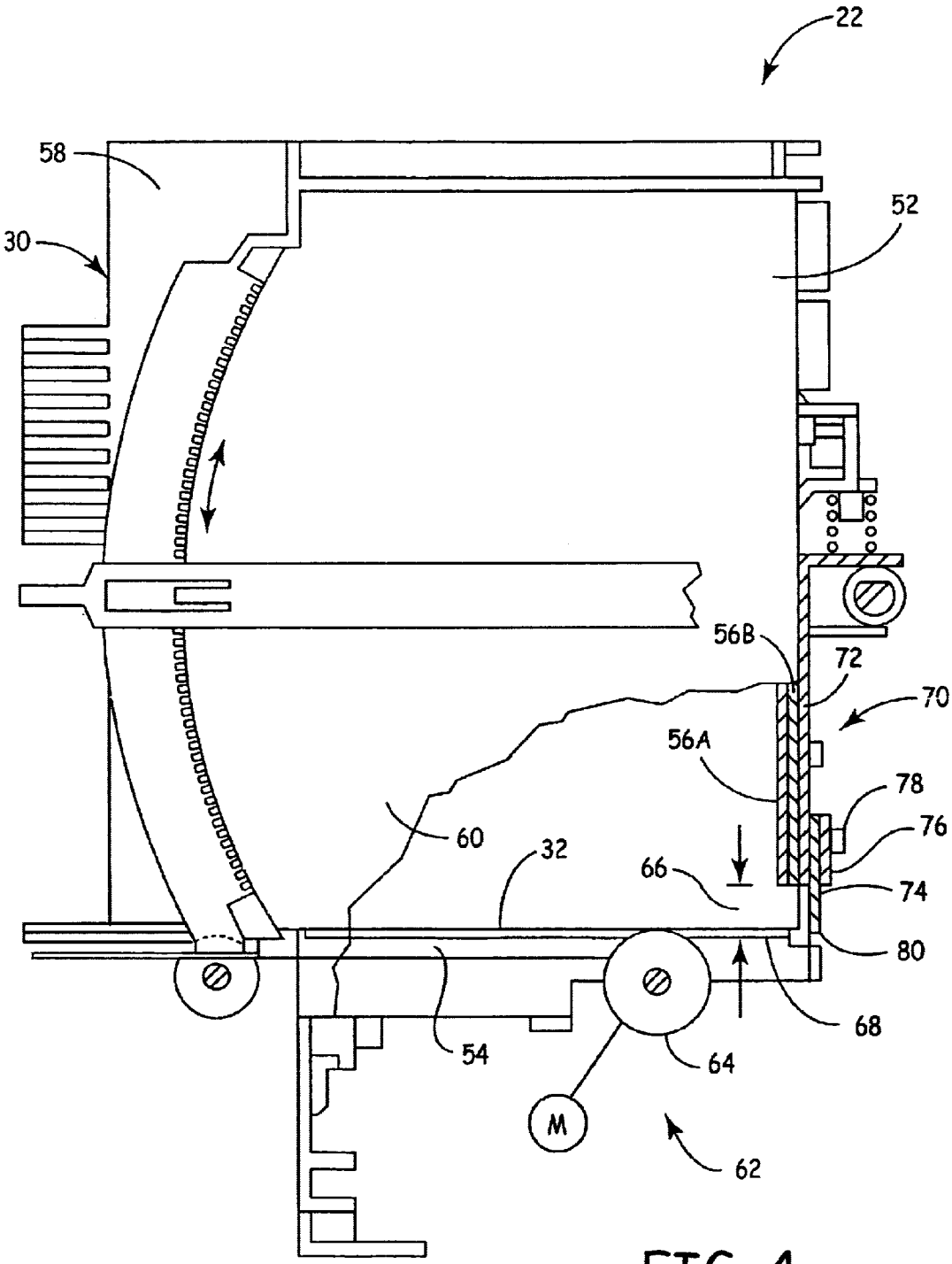
FIG. 4 is a side view of the card supply of FIG. 3 with parts in section and broken away.

An example of a card hopper 30 of card supply 22 is shown in FIGS. 3 and 4. Card hopper 30 includes a card housing 52 that is adapted to contain a supply of cards 32. Card housing 52 includes a bottom 54, an outlet wall 56, and sidewalls 58 and 60. An end card 32 is shown in FIG. 4 at bottom 54 of the hopper 30 in position for a card feeder 62 to drive card 32 toward outlet wall 56 leading to transport mechanism 26. The card feeder 62 comprises conventional drive rollers, such as drive roller 64. Housing 52 can include a cover to form a substantially sealed card supply 22, as shown in FIG. 1.

The cards 32 are fed through an outlet opening 66 of outlet wall 56 to transport mechanism 26 of printing system 20. Outlet opening 66 is defined by a card support plane of the card feeder, or if the hopper has a bottom tray, by the bottom tray. A card 32 is shown in position in FIG. 4 adjacent to the opening 66. The card support plane is defined by the bottom surface of that card and bottom edge 68. The maximum height of the hopper outlet opening 66 is defined by the lower edges of front wall sections 56A and 56B. As discussed in greater detail below, a control gate or gate assembly 70 controls the actual height of the outlet opening 66 and allows cards of different thicknesses to be fed to transport mechanism 26 while avoiding misfeeds.

Gate assembly 70 generally includes a slide plate 72 and a flexible blade 74 having a bottom edge 31. Flexible blade 74 can be mounted to slide plate 72 in accordance with conventional methods. In one embodiment, flexible blade 74 is sandwiched between plate 76 and slide plate 72 and secured by screws 78. Alternatively, flexible blade 74 could be formed integral with slide plate 72. Gate assembly 70 could also be formed as a portion of printing system 20 rather than card hopper 30, such that it aligns with the outlet opening of card hopper 30 when the card supply is installed in printing system 30.

The vertical position of gate assembly 70 can be adjusted along the front wall 56 such that the bottom edge or surface 80 will change in vertical height relative to the support plane of the bottom card 32 in the hopper 30 so that the effective vertical height of the outlet opening 66 can be adjusted. The slide plate 72 has a center inset region 82 with a slot 84 defined therein. Suitable guides 86 are fixed to the wall section 56B, and the guides slide in the slot and hold the gate in proper position against front wall section 56B. The guides have wings 88 that fit over the sides of the slot. The slot has notches 90 which will permit removal of the slide from the guides when the notches are aligned with the wings 88.

The vertical position of slide plate 72 of gate 70 is adjusted such that flexible blade 74 is positioned to engage the front edge of bottom card 32 as it is driven out opening 66. When in this position, flexible blade 74 will flex in response to the thickness of the card being driven through opening 66 to automatically adjust the height of the opening 66 accommodate the card while preventing multiple card feeds. This aspect of the present invention is advantageous over gates of the prior art since, for a given vertical position of slide plate 72, opening 66 will automatically adjust in response to the thickness of the card being driven therethrough to accommodate a range of card thicknesses as well as warped cards. This eliminates the necessity to adjust the gate position each time the card thickness changes, as is the case with gates of the prior art.

Figure 5:
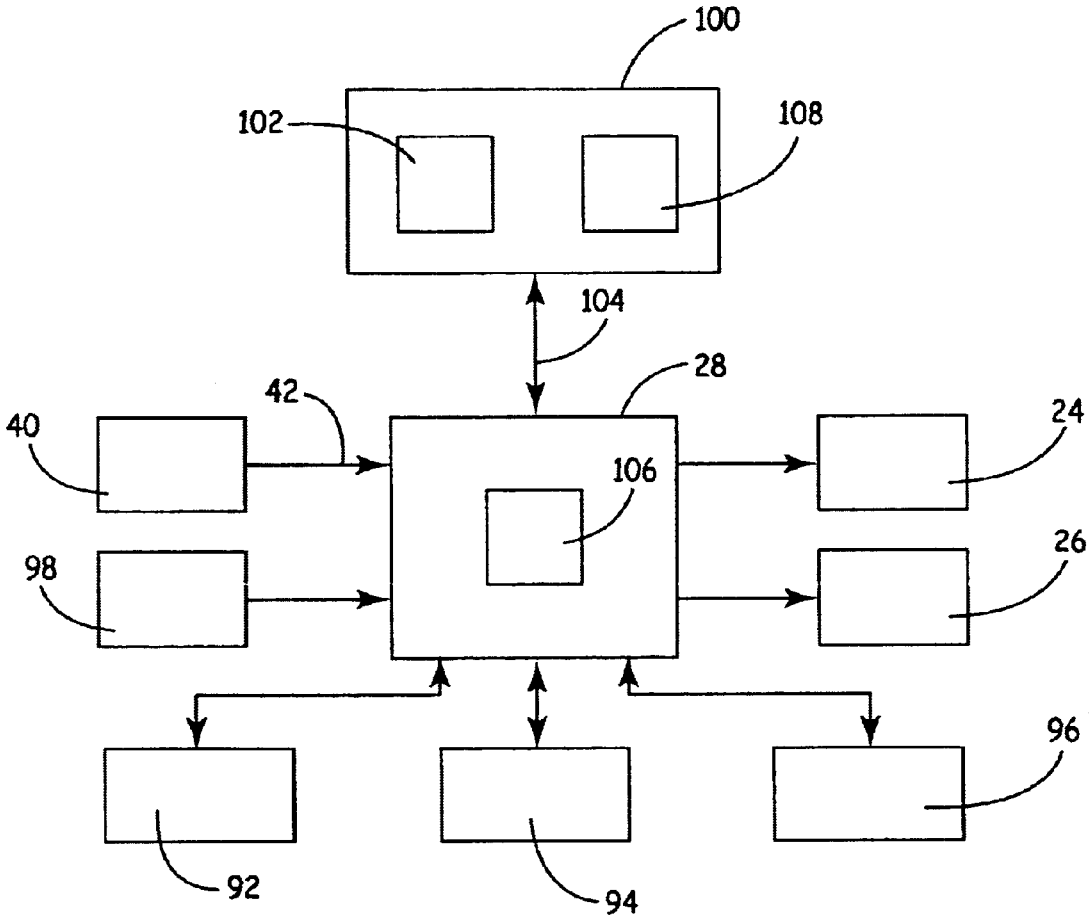
FIG. 5 is a simplified block diagram illustrating communication signals between a printer controller and components of an identification card printing system as well as external devices.

Controller 28 communicates with and controls the various components of printer 20, as best shown in the block diagram of FIG. 5. For example, controller 28 can communicate with transport mechanism 26 to control the driving of pinch rollers 34 and guide rollers 36 to drive a card 32, received from supply 22, forward and backward along print path 38 and position card 32 for printing by printhead 24. Controller 28 can also provide output information on a display 92 and communicate with memory 94 to retrieve and store data. Additionally, controller 28 can be in communication with a personal computer (PC) 96 and various input devices 98 over suitable connections, such as a parallel cable, a serial cable, or a universal serial bus (USB) cable.

An operator may use PC 96 to configure and format a print job using a software application. Data relating to the print job is then provided to controller 28, which is used to process the print job by controlling the various components of printer 20. The print job can also be formed from data received by input devices 98. Input devices 98 could be, for example, a keyboard, a camera, a scanner, or other input device. Software running on PC 96 or printer 20 can be used to retrieve the data from an input device 98 and use the data to form a print job.

In accordance with an embodiment of the invention, card supply 22 includes a supply circuit 100 mounted to hopper 30, as shown in FIG. 1. Supply circuit 46 includes a memory 48 containing supply information relating to various parameters of card supply 22 and other information. Controller 28 communicates with supply circuit 100 over a suitable communication link 104 (FIG. 5) to send and receive the supply information. Controller 28 can use the supply information for various purposes, such as displaying it on display 92 (FIG. 1).

Examples of supply information are depicted in the memory map of FIG. 6 for memory 102, which includes eight blocks (block 0 through block 7) each having 32 bits (address of 0–31). The supply information can relate to, for example, a card supply identifier, card type, card dimensions (length, width and thickness), card features, card identifiers, card orientation, a card count, card supplier information (i.e. lot number), dealer information, security codes, an expiration date, and printer settings. Those skilled in the art appreciate that other types of supply information can be stored in memory 102 that would be useful to the operation of printing system 20. The supply information given above merely contains examples of such information.

The card type identifies a pre-defined type of card such as a CR-80, CR-90 or other standardized type of card. The card features can include such things as whether the card has a magnetic stripe, is a "smart" card, and other conventional card features. The card supply identifier allows for a check to be performed to determine whether the card supply 22 or the cards 32 stored therein are compatible with printing system 20. The card identifiers could be a series of serial numbers that uniquely identify each card stored in the card supply. This information could be used, for example, to correlate the printed identification card with the person who printed the card. The card orientation relates to whether the card is being fed lengthwise or widthwise along printing path 38. The printer settings allow the printing system 20 to be configured for optimal performance. The card dealer information relates to the dealer that sold the card supply, which may be responsible for customizing the supply information stored in memory 102. The card count relates to the number of cards 32 in the card supply. For example, the card count can initially relate to a number of cards in an unused card supply, which can be updated by subtracting the number of processed cards to maintain a remaining card count.

The security codes can be used to prevent unauthorized use of the cards or prevent the use of the card supply 22 with unauthorized printing systems. An improper security code could, for example, trigger an interlock in printing system 20 to prevent the operation thereof. The expiration date can be used as a security measure to prevent the use of the cards after a predetermined date.

For additional security, the supply information stored in memory 102 of supply circuit 100 and communicated between supply circuit 100 and controller 28 can be encrypted. In this embodiment, controller 28 is adapted to decrypt the encrypted supply information as well as encrypt supply information that is transmitted to supply circuit 100.

Input devices 98 (FIG. 1) can include a key card input, in which a programmed key card or "smart" card key can be inserted to ensure that the printer 20, and thus the card supply 22, will not be operated unless the correct key card has been inserted and the correct algorithm interpreted for unlocking or enabling the printer controller 28. The use of such a smart card is set forth in U.S. application Ser. No. 09/263,343, filed Mar. 5, 1999 and entitled "SECURITY PRINTING AND UNLOCKING MECHANISM FOR HIGH SECURITY PRINTERS," which is incorporated herein by reference. Key card inputs are known in the field, and can comprise a number of different signals that can be used in an algorithm to ensure that the printer controller would be unlocked or enabled only when the appropriate card is inserted. The card also can include information that can be correlated to a checking of a security code or password stored in memory 102 of supply circuit 100, as mentioned above for comparison to a corresponding security code or password that is accessible by controller 28 from an input by a user of printing system 20 or stored in memory 94 (FIG. 5) to ensure that an appropriate or authorized card supply 22 is attached before the printer controller 28 is unlocked for use.

Communication link 104 can be a physical communication link or a wireless communication link. In accordance with one embodiment of the invention, controller and supply circuit 100 each include a radio frequency (RF) communication circuit 106 and 108, respectively, for wireless communication of supply information therebetween.

Figure 7:
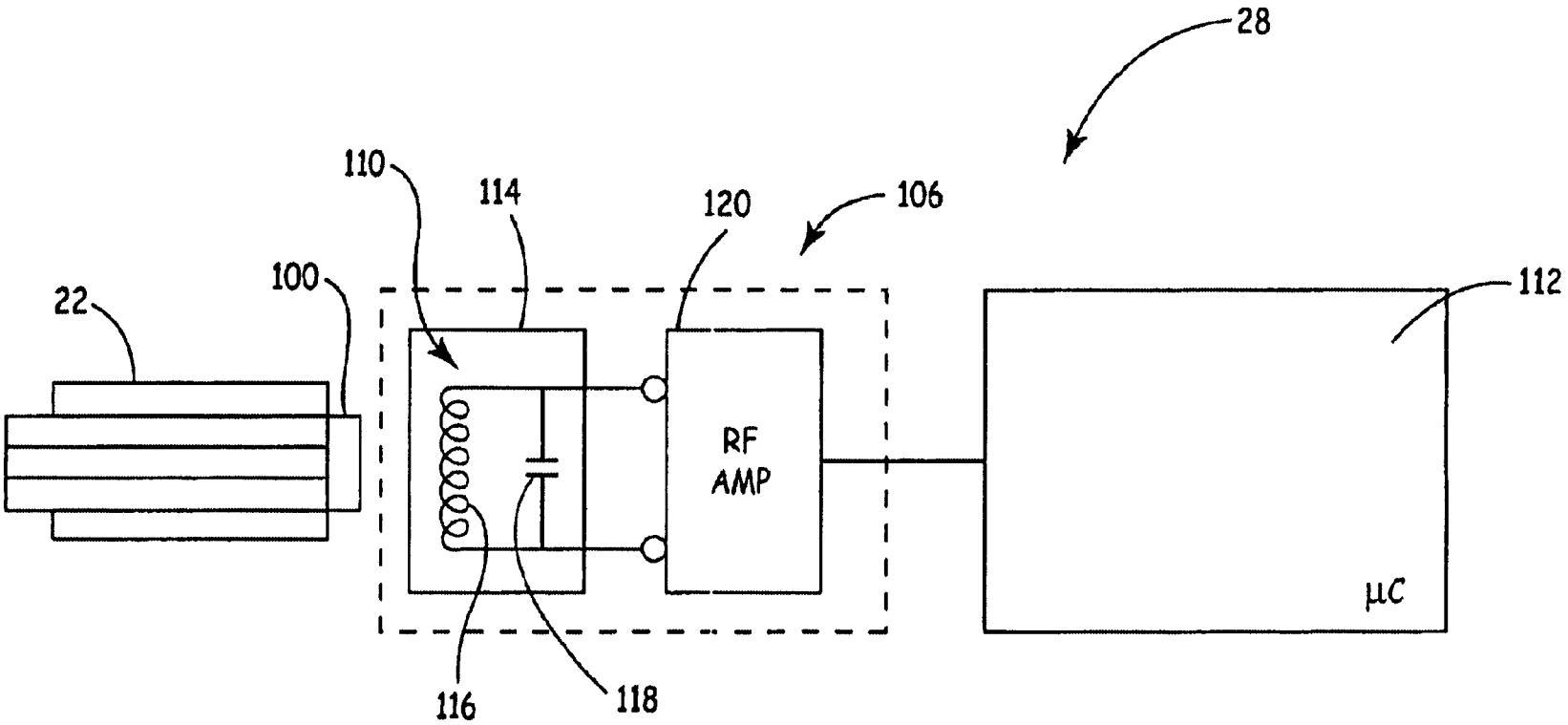
FIG. 7 is a simplified block diagram of a communication circuit of a printer controller in accordance with an embodiment of the invention.

Communication circuit 106 of controller 28 includes a transceiver circuit 110, as represented schematically in FIG. 7. Transceiver 110 provides signals to a microprocessor 112 of controller 28 that are received from communication circuit 108 of supply circuit 100. Signals from controller 28 are transmitted to supply circuit 100 using an antenna 114. Antenna 114 of transceiver 106 includes a coil 116 and a capacitor 118. Antenna 114 provides the signal to a radio frequency amplifier 120 which, in turn, provides the data signals to microprocessor 112 of controller 28.

Figure 8:
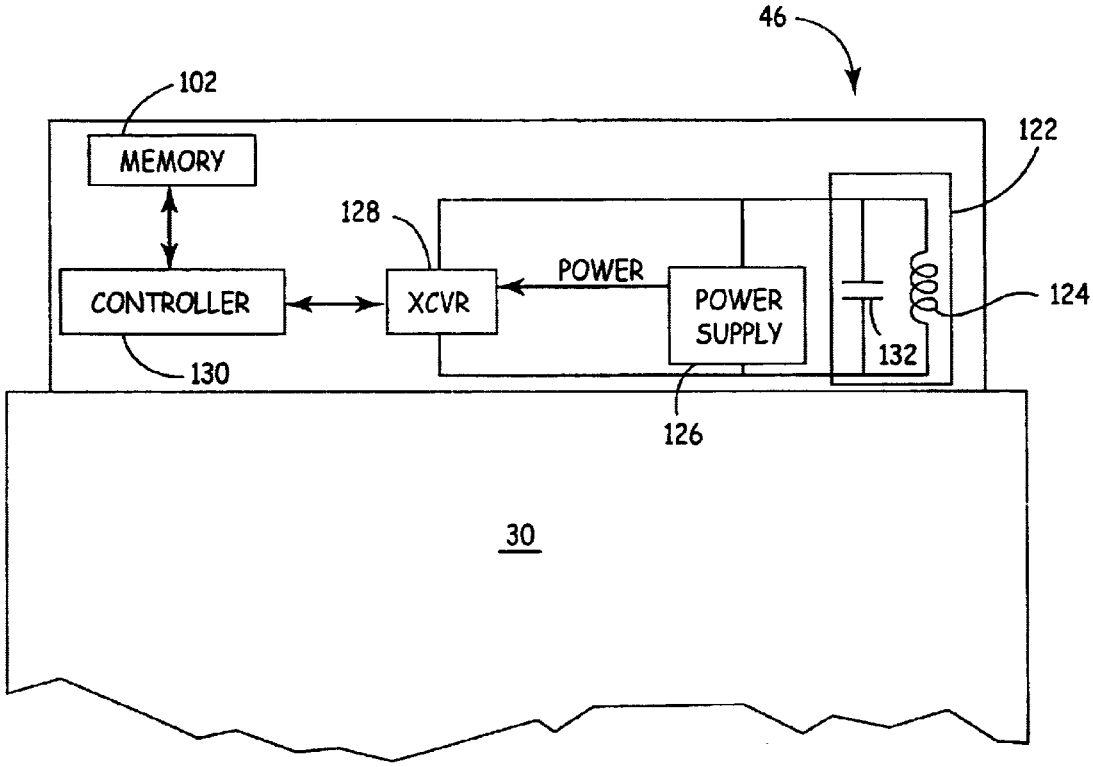
FIG. 8 is a simplified block diagram of a communication circuit of a supply circuit in accordance with an embodiment of the invention.

FIG. 8 is a simplified block diagram showing supply circuit 100 mounted to card supply 22. Supply circuit 100 includes an antenna 122 formed by an electrical coil 124 which couples to a power supply 126 and transceiver circuitry 128. A controller 130 couples to memory 102 and to transceiver circuitry 128. A tuning capacitor 132 is also provided in series with coil 124. Controller 130 of supply circuit 100 receives data signals from transceiver 128. Controller 130 can write information to, or read information from, memory 102 to provide bi-directional communication between supply circuit 100 and controller 28.

In accordance with one embodiment, coil 116 of transceiver 110 is powered by RF amplifier 120 such than an inductive coupling occurs with coil 124 of supply circuit 100 when the two are placed in close proximity. Power supply 126 can then generate a stable power output used to power all of the circuitry within supply circuit 100 received through the inductive coupling with coil 116. Thus, transceiver 110 can transfer power to transceiver 128 of supply circuit 100, which responsively transmits data signals over the wireless communication link back to transceiver 110. By modulating the signal, data can be transferred between transceiver 110 and supply circuit 100. Alternatively, power supply 126 can be an internal power source such as a battery.

The signal used to drive coil 116 of transceiver 110 can be a 125 kilohertz signal, which then inductively couples to coil 124 of supply circuit 100, in accordance with one embodiment of the invention. In accordance with another embodiment, a 13.56 megahertz signal is used to drive coil 116 in accordance with standardized radio frequency communication protocols.

Another wireless embodiment of communication link 104 uses a magnetic field to transmit information. This can be accomplished by using a magnetic head instead of an RF antenna. In accordance with yet another embodiment, a wireless communication link can take the form of an optical connection that is provided between supply circuit 100 and printing system 20.

In accordance with another embodiment of the present invention, communication link 104 is a physical connection such as through electrical wiring. In this embodiment, supply circuit 100 includes electrical contacts to which the printing system 20 makes electrical contact when the card supply 22 is coupled to printing system 20. Power for supply circuit 100 can then be provided over the electrical connection. In accordance with one embodiment, a single pair of electrical connections are provided which carry both power and data between supply circuit 100 and controller 28.

Figure 9:
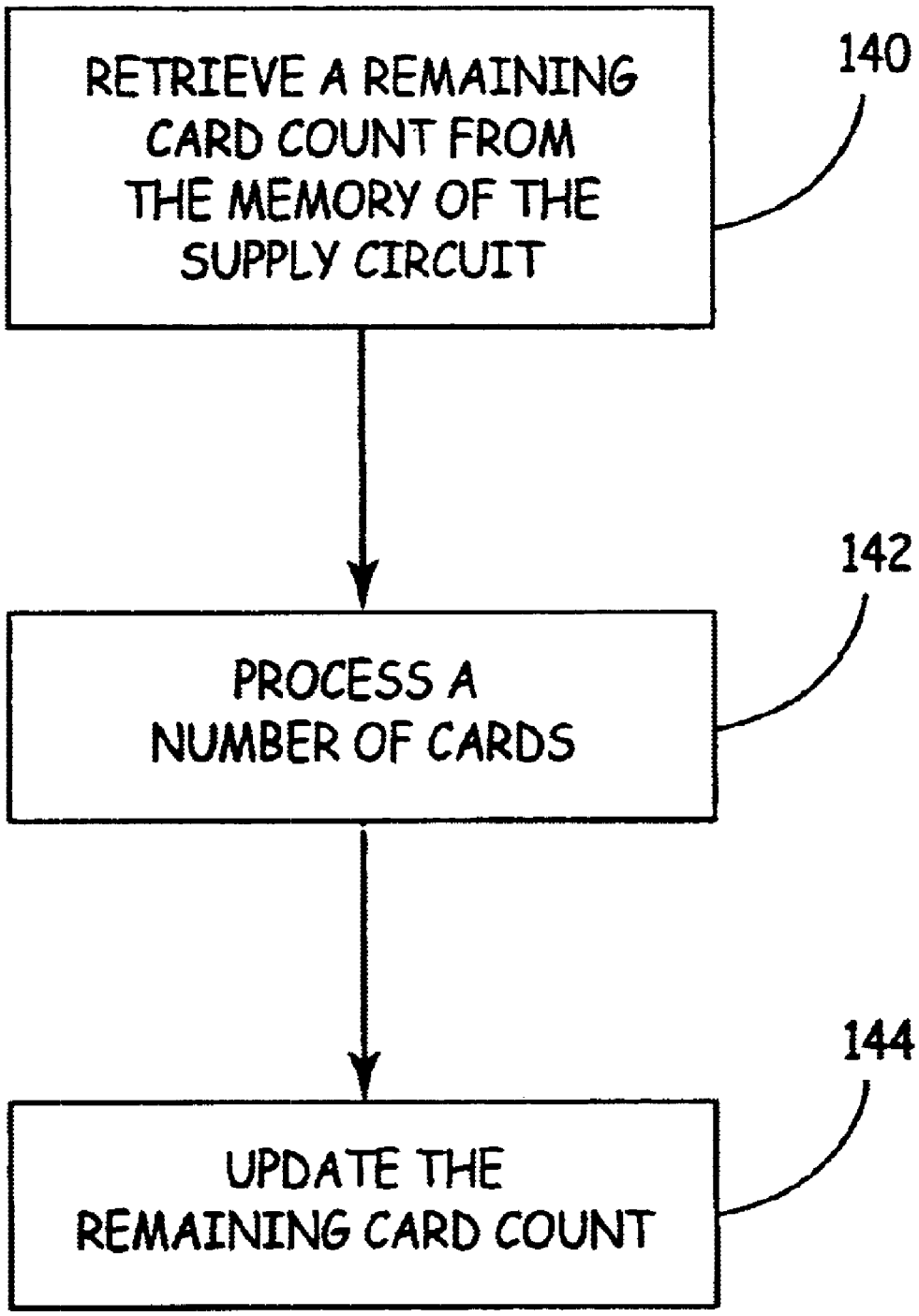
FIG. 9 is a flowchart illustrating a method for use with an identification card printing system to manage a card supply in accordance with an embodiment of the invention.

In operation, printing system 20 manages card supply 22 by retrieving the supply information from memory 102 and using the supply information during the processing of cards. FIG. 9 is a flowchart illustrating an embodiment of a method of the present invention. At step 140, supply information is retrieved from memory 102 of supply circuit 100. The supply information includes a remaining card count corresponding to a number of cards 32 remaining in the stack of card supply 22. Next, at step 142, a number of cards 32 are processed by printing system 20. During the processing of cards 32, sensor 40 provides an output signal to controller 28 that is used by controller 28 to maintain a count of the number of cards 32 that are processed.

At step 144 of the method, the remaining card count in memory 102 of supply circuit 100 is updated by subtracting the number of cards that were processed. This is generally accomplished by a communication between controller 28 and supply circuit 100 that results in the overwriting of the previous remaining card count in memory 102 with an updated remaining card count. When card supply 22 is subsequently removed from printing system 20, the updated remaining card count will be known when it is used next.

Although the present invention has been described with reference to preferred embodiments, workers skilled in the art will recognize that changes may be made in form and detail without departing from the spirit and scope of the invention.

What is claimed is:

1. A card supply for use with an identification card printing system comprising:

a card hopper containing a stack of cards and including:

an end wall having an outlet opening therethrough aligned with an end card; and a control gate that adjusts a height of the outlet opening; and a supply circuit mounted to the card hopper and having a memory containing supply information relating to parameters of the card supply.

2. An identification card printing system comprising:

the card supply of claim 1; and a controller in electronic communication with the supply circuit and adapted to access the supply information stored in the memory.

3. The card supply of claim 1, wherein the card hopper includes:

a card housing having an opening for containing the stacked cards; and wherein the control gate has a flexible blade at the outlet opening that reduces a height of the outlet opening to less than a thickness of the end card, whereby the flexible blade flexes in response to the card when driven through the outlet opening by a card feeder mechanism.

4. The card supply of claim 1, wherein the supply information relates to at least one parameter selected from a group consisting of card type, card size, card features, card identifiers, initial card count corresponding to a number of cards contained in an unused card supply, a remaining card count corresponding to a number of cards remaining in the card supply, card thickness, card orientation, card supplier information, dealer information, a security code, and a printer setting for the card supply.

5. The identification card printing system of claim 2, wherein the controller includes a communication circuit for accessing the supply information in the memory of the supply circuit through one of a wireless communication link, a physical communication link and a radio frequency (RF) communication link.

6. The identification card printing system of claim 5, wherein the controller includes a radio frequency (RF) communication circuit that receives the supply information from the supply circuit through the RF communication link in accordance with a communication protocol.

7. The identification card printing system of claim 6, wherein the supply circuit includes an antenna for receiving radio frequency (RF) signals.

8. The identification card printing system of claim 2, including a card sensor for detecting a feature of a transported or processed card and having an output signal providing detected card information.

9. The identification card printing system of claim 8, wherein the output signal provides notice of a processed or transported card and the supply information includes a remaining card count, which is updated by the controller in accordance with the output signal.

10. The identification card printing system of claim 8, wherein the card sensor includes a signal source adapted to generate a signal that is directed to a signal receiver, wherein the signal is broken by cards being processed.

11. The identification card printing system of claim 8, wherein the feature is a marking on the card that is detectable by the sensor and is selected from a group consisting of a hologram, a barcode, a pattern, and a watermark.

12. The identification card printing system of claim 2, including a key card input for receiving a key card code, wherein the controller controls printer operation in accordance with a comparison between the key card code and a corresponding code stored in the memory of the supply circuit.

13. The card supply of claim 3, wherein the supply circuit further includes an antenna.

14. The card supply of claim 1, wherein the supply information is encrypted.

15. The identification card printing system of claim 2, wherein the supply information stored in the memory is encrypted and the controller is adapted to decrypt the encrypted supply information.

16. An identification card printing system comprising:

a card supply including a card hopper containing a stack of cards;

a supply circuit mounted to the card supply and having a memory containing supply information relating to parameters of the card supply;

a print head;

a transport mechanism adapted to transport cards along a print path and present the cards to the print head for printing; and a controller adapted to access the supply information and control printer operation in accordance with a comparison between a printer operation parameter and a corresponding parameter stored in the memory of the supply circuit.

17. The identification card printing system of claim 16, wherein the card hopper includes:

a card housing having an opening for containing the stacked cards;

an end wall having an outlet opening therethrough aligned with an end card; and a control gate having a flexible blade at the outlet opening that reduces a height of the outlet opening to less than a thickness of the end card, whereby the flexible blade flexes in response to the card when driven through the outlet opening by a card feeder mechanism.

18. The identification card printer of claim 16, wherein the supply information relates to at least one parameter selected from a group consisting of card type, card size, card features, card identifiers, initial card count corresponding to a number of cards contained in an unused card supply, a remaining card count corresponding to a number of cards remaining in the card supply, card thickness, card orientation, card supplier information, dealer information, a security code, and a printer setting for the card supply.

19. The identification card printing system of claim 16, wherein the controller includes a communication circuit for accessing the supply information in the memory of the supply circuit through one of a wireless communication link, a physical communication link and a radio frequency (RF) communication link.

20. The identification card printing system of claim 19, wherein the controller includes a radio frequency (RF) communication circuit that receives the supply information from the supply circuit through the RF communication link in accordance with a communication protocol.

21. The identification card printing system of claim 20, wherein the supply circuit includes an antenna for receiving radio frequency (RF) signals.

22. The identification card printing system of claim 16, including a card sensor for detecting a feature of a transported or processed card and having an output signal providing detected card information.

23. The identification card printing system of claim 22, wherein the output signal provides notice of a processed or transported card and the supply information includes a remaining card count, which is updated by the controller in accordance with the output signal.

24. The identification card printing system of claim 22, wherein the card sensor includes a signal source adapted to generate a signal that is directed to a signal receiver, wherein the signal is broken by cards being processed.

25. The identification card printing system of claim 22, wherein the feature is a marking on the card that is detectable by the sensor and is selected from a group consisting of a hologram, a barcode, a pattern, and a watermark.

26. The identification card printing system of claim 16, including a key card input for receiving a key card code, wherein the controller controls printer operation in accordance with a comparison between the key card code and a corresponding code stored in the memory of the supply circuit.

27. The card supply of claim 16, wherein the supply information is encrypted.

28. The identification card printing system of claim 27, wherein the controller is adapted to decrypt the encrypted supply information.

29. A method for use with an identification card printing system to manage a card supply having a card hopper containing a stack of cards and a supply circuit mounted to the card hopper and having a memory containing supply information relating to parameters of the card supply, the method comprising steps of:

(a) retrieving supply information from the memory; and (b) using the supply information during processing of cards; and (c) controlling operation of the identification card printing system based on the supply information.

30. The method of claim 29, wherein:

the supply information includes a remaining card count corresponding to a number of cards remaining in the stack; and the using step (b) includes:

(b) (1) processing a number of cards; and (b) (2) updating the remaining card count in the memory by subtracting the number of cards that were processed.

31. The method of claim 29, wherein:

the supply information includes a remaining card count corresponding to a number of cards remaining in the stack; and the using step (b) includes:

(b) (1) retrieving the supply information from the memory;

(b) (2) counting a number of processed or transported cards;

(b) (3) updating the remaining card count by subtracting the number of processed or transported cards; and (b) (4) storing the updated remaining card count in the memory of the supply circuit.

32. The method of claim 29, wherein the using step (b) includes displaying the retrieved supply information to a user.

33. The method of claim 29, wherein the using step (b) includes checking card compatibility with the identification card printing system based on the supply information.

34. The method of claim 29, wherein the supply information relates to at least one parameter selected from a group consisting of card type, card size, card features, card identifiers, initial card count corresponding to a number of cards contained in an unused card supply, a remaining card count corresponding to a number of cards remaining in the card supply, card thickness, card orientation, card supplier information, dealer information, a security code, and a printer setting for the card supply.

35. The method of claim 29, wherein the controlling step (c) includes receiving a security input code and operating the identification and printing system in accordance with a comparison between the security input code and a corresponding code stored with the supply information.

36. A card supply for use with an identification card printing system comprising:

a card hopper containing a stack of cards; and a supply circuit mounted to the card hopper and having a memory containing supply information relating to parameters of the card supply including at least one of card size, card thickness, card orientation, card supplier information, dealer information and a printer setting for the card supply.

37. An identification card printing system comprising:

the card supply of claim 36; and a controller in electronic communication with the supply circuit and adapted to access the supply information stored in the memory.

38. The card supply of claim 36, wherein the card hopper includes:

a card housing having an opening for containing the stacked cards;

an end wall having an outlet opening therethrough aligned with an end card; and a control gate having a flexible blade at the outlet opening that reduces a height of the outlet opening to less than a thickness of the end card, whereby the flexible blade flexes in response to the card when driven through the outlet opening by a card feeder mechanism.

39. The card supply of claim 36, wherein the supply information further includes at least one parameter selected from a group consisting of card type, card features, card identifiers, initial card count corresponding to a number of cards contained in an unused card supply, a remaining card count corresponding to a number of cards remaining in the card supply and a security code.

40. The identification card printing system of claim 37, wherein the controller includes a communication circuit for accessing the supply information in the memory of the supply circuit through one of a wireless communication link, a physical communication link and a radio frequency (RF) communication link.

41. The identification card printing system of claim 37, including a card sensor for detecting a feature of a transported or processed card and having an output signal providing detected card information.

42. The identification card printing system of claim 41, wherein the output signal provides notice of a processed or transported card and the supply information includes a remaining card count, which is updated by the controller in accordance with the output signal.

43. The identification card printing system of claim 41, wherein the card sensor includes a signal source adapted to generate a signal that is directed to a signal receiver, wherein the signal is broken by cards being processed.

44. The identification card printing system of claim 41, wherein the feature is a marking on the card that is detectable by the sensor and is selected from a group consisting of a hologram, a barcode, a pattern, and a watermark.

45. The identification card printing system of claim 37, including a key card input for receiving a key card code, wherein the controller controls printer operation in accordance with a comparison between the key card code and a corresponding code stored in the memory of the supply circuit.

46. The card supply of claim 36, wherein the supply information is encrypted.

47. The identification card printing system of claim 37, wherein the supply information stored in the memory is encrypted and the controller is adapted to decrypt the encrypted supply information.

* * * * *